US009828790B2

(12) United States Patent
Hill

(10) Patent No.: US 9,828,790 B2
(45) Date of Patent: Nov. 28, 2017

(54) CODE CHANGE BLOCKER

(71) Applicant: UTC Fire & Security Americas Corporation, Inc., Bradenton, FL (US)

(72) Inventor: Matthew S. Hill, Sublimity, OR (US)

(73) Assignee: UTC FIRE & SECURITY AMERICAS CORPORATION, INC., Bradenton, FL (US)

( * ) Notice: Subject to any disclaimer, the term of this patent is extended or adjusted under 35 U.S.C. 154(b) by 731 days.

(21) Appl. No.: 13/767,319

(22) Filed: Feb. 14, 2013

(65) Prior Publication Data

US 2013/0219977 A1 Aug. 29, 2013

Related U.S. Application Data

(60) Provisional application No. 61/603,609, filed on Feb. 27, 2012.

(51) Int. Cl.
*E05B 37/16* (2006.01)
*E05B 37/00* (2006.01)

(52) U.S. Cl.
CPC ..... *E05B 37/16* (2013.01); *E05B 37/0048* (2013.01); *E05B 37/163* (2013.01); *Y10T 70/7322* (2015.04)

(58) Field of Classification Search
USPC ..... 70/214, 286, 291, 294, 297–299
See application file for complete search history.

(56) References Cited

U.S. PATENT DOCUMENTS

| | | | | |
|---|---|---|---|---|
| 1,092,733 | A * | 4/1914 | McCarthy | 70/483 |
| 1,430,332 | A * | 9/1922 | Smith | 70/149 |
| 3,009,346 | A * | 11/1961 | Check | 70/150 |
| 4,748,833 | A * | 6/1988 | Nagasawa | 70/214 |
| 4,936,894 | A | 6/1990 | Larson et al. | |
| 5,488,338 | A | 1/1996 | Seymour et al. | |
| 5,768,921 | A | 6/1998 | Hill | |
| 6,145,355 | A | 11/2000 | Burleigh et al. | |
| 6,272,889 | B1 | 8/2001 | Burleigh et al. | |
| 6,298,698 | B1 * | 10/2001 | Nakajima et al. | 70/214 |
| 6,334,346 | B1 * | 1/2002 | Wang | 70/214 |
| 7,043,948 | B1 * | 5/2006 | Wang | 70/214 |
| 7,297,886 | B2 | 11/2007 | Noguchi et al. | |
| 7,318,331 | B2 * | 1/2008 | Miao | 70/214 |
| 2005/0069855 | A1 | 3/2005 | Engl et al. | |
| 2005/0210937 | A1 * | 9/2005 | Okuda | 70/214 |

* cited by examiner

*Primary Examiner* — Christopher Boswell
(74) *Attorney, Agent, or Firm* — Cantor Colburn LLP

(57) ABSTRACT

A lock assembly including a plurality of button assemblies having a plurality of indicator elements. A position of the indicator elements sets a lock combination. A code blocker is configured to cover and prevent access to the plurality of button assemblies when the lock assembly is in a first position, for example in an unlocked position, and to allow access to the plurality of button assemblies when the lock assembly is in a second position, for example in a locked position.

11 Claims, 3 Drawing Sheets

CODE CHANGE BLOCKER

CROSS REFERENCE TO RELATED APPLICATION

This application claims priority to provisional U.S. patent application Ser. No. 61/603,609 filed Feb. 27, 2012, the disclosure of which is herein incorporated by reference in its entirety.

FIELD OF THE EMBODIMENTS

The present teachings relate to a lock assembly and, more particularly, to a pushbutton lock which includes mechanical safeguard against unintentional damage caused by an end user.

BACKGROUND OF THE EMBODIMENTS

Pushbutton locks are well known and find many uses. A conventional combination lock can be used, for example, on a lockbox which stores an item such as a key. To gain access to the inside of the lockbox and the key, a correct combination must be selected from the outside of the lock and an open handle (i.e., knob) is rotated to retract a locking bolt and gain access to the inside of the lock. Conventional combination locks are discussed in the following U.S. patents, each of which is incorporated herein by reference in its entirety: 4,936,894; 5,768,921; 6,145,355; and 6,272,889.

Conventional locks can include an array of elongated buttons, each of which has, on the sides thereof, plural cut-outs, or "gates." A case contains the lock and defines plural bores within which the buttons travel. The buttons are urged out of a front cover of the case toward the user by biasing springs. Plural latching members cooperate with features on the button array to hold same in a depressed position against the force of the biasing springs when the buttons are pushed in by an operator of the lock.

The conventional lock further includes a locking bolt which is coupled to a checker plate. The checker plate defines plural edges that engage the sides of the button assemblies and are received in the gates therein if the buttons are properly positioned. The checker plate is slidably mounted in a track within the case and is normally urged to a first end of the track by another biasing spring. When the checker is at this first end of its travel, the bolt is in its locked position.

The knob is coupled to the checker plate and can be operated to urge the checker plate towards a second end of its track. However, the checker plate is prevented from moving to the second end of its track if the portions of the buttons engaged by the edges of the checker plate do not include gates.

By the foregoing arrangement, all of the buttons must be properly positioned, either in or out, if the checker plate is to be moved to its second position so as to move the bolt to the unlocked position. If even one button is incorrectly positioned the checker plate will contact the button assembly at a location which does not include a gate, which prevents the checker plate from moving to its unlocked position.

SUMMARY OF THE EMBODIMENTS

The following presents a simplified summary in order to provide a basic understanding of some aspects of one or more embodiments of the present teachings. This summary is not an extensive overview, nor is it intended to identify key or critical elements of the present teachings nor to delineate the scope of the disclosure. Rather, its primary purpose is merely to present one or more concepts in simplified form as a prelude to the detailed description presented later.

An embodiment of a lock assembly according to the present teachings can include a plurality of button assemblies comprising a plurality of indicator elements, wherein a position of the plurality of indicator elements sets a lock combination, and a code blocker having a plurality of openings therein, wherein the code blocker covers the plurality of indicator elements when the lock assembly is in a first position and exposes the plurality of indicator elements through the plurality of openings when the lock assembly is in a second position.

Another embodiment according to the present teachings can include a lock assembly having a user-selectable lock combination, wherein the lock combination is selectable using a method comprising entering a correct lock combination, providing a first rotation of a clutch to move a locking bolt from a locked position to an unlocked position and to move a code blocker from a first position which exposes a plurality of button assemblies through a plurality of openings in the code blocker to a second position which covers the plurality of button assemblies, providing a second rotation of the clutch after the first rotation to move the locking bolt from the unlocked position to the locked position and to move the code blocker from the second position which covers the plurality of button assemblies to the first position which exposes the plurality of button assemblies and, with the locking bolt in the locked position, selecting a lock combination using the plurality of exposed button assemblies.

BRIEF DESCRIPTION OF THE DRAWINGS

The accompanying drawings, which are incorporated in and constitute a part of this specification, illustrate embodiments of the present teachings and together with the description, serve to explain the principles of the disclosure. In the figures.

It should be noted that some details of the FIGS. have been simplified and are drawn to facilitate understanding of the present teachings rather than to maintain strict structural accuracy, detail, and scale.

DESCRIPTION OF THE EMBODIMENTS

Reference will now be made in detail to the embodiments of the present teachings, an example of which is illustrated in the accompanying drawings. Wherever possible, the same reference numbers will be used throughout the drawings to refer to the same or like parts.

Figure 1:
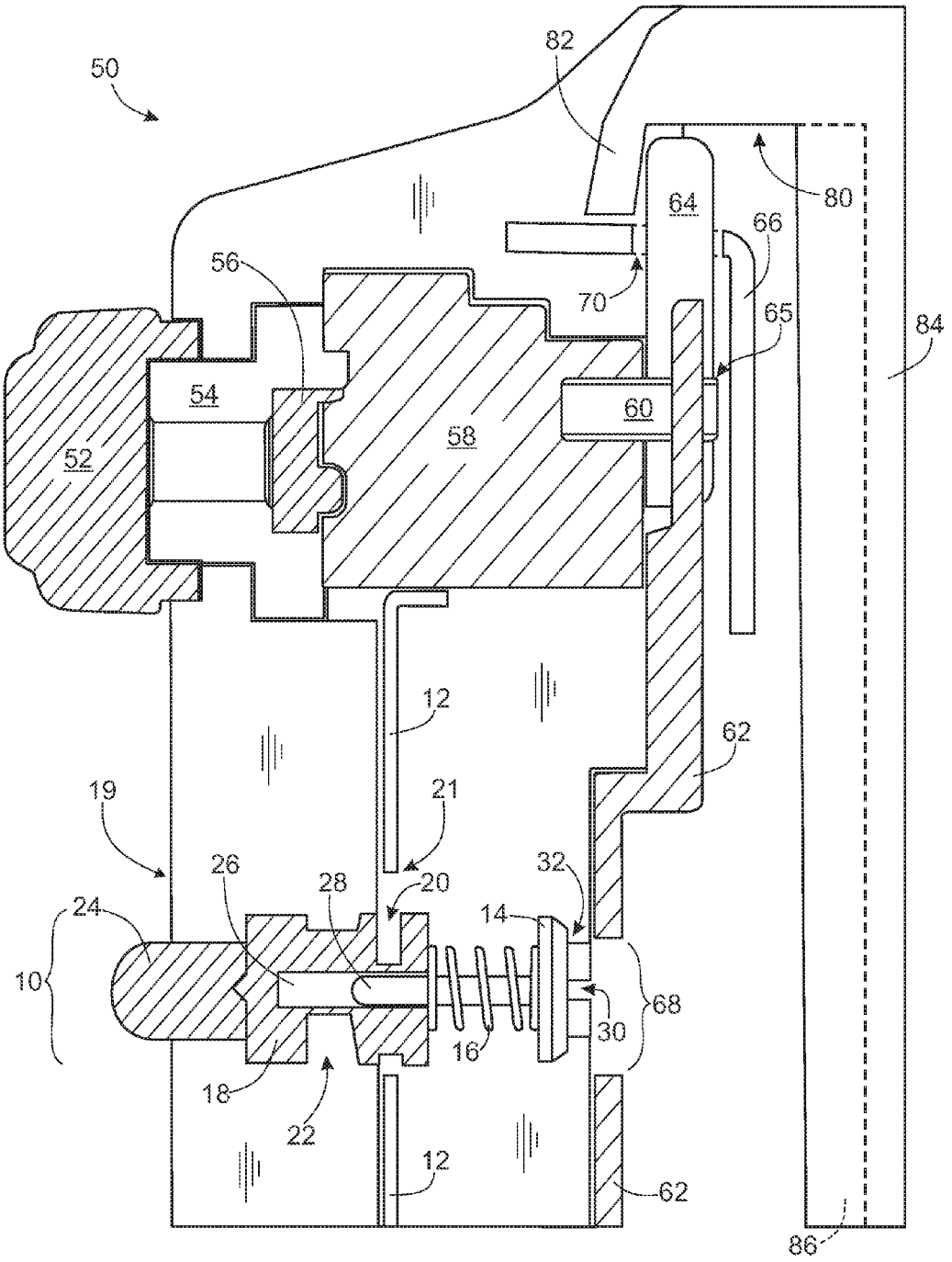
FIGS. 1 is a cross section depicting a portion of a mechanical lock assembly in a locked position.

FIG. 1 depicts a mechanical lock assembly (e.g., a lockbox) 50, which includes a checker plate 12 and a plurality of mechanical button assemblies, with one button assembly 10 depicted. Each button assembly 10 includes an indicator element 14, a spring 16, and a button body 18. The button body 18 includes side gates 20, 22, a button tip 24, and a slotted internal bore or channel 26 which receives a front portion 28 of the indicator element 14. The indicator element 14 further includes a slot 30 for changing the lock combination as described below. Spring 16 serves to bias the button tip 24 away from the indicator element 14 and out the face 19 of the lock assembly 50.

Figure 2:
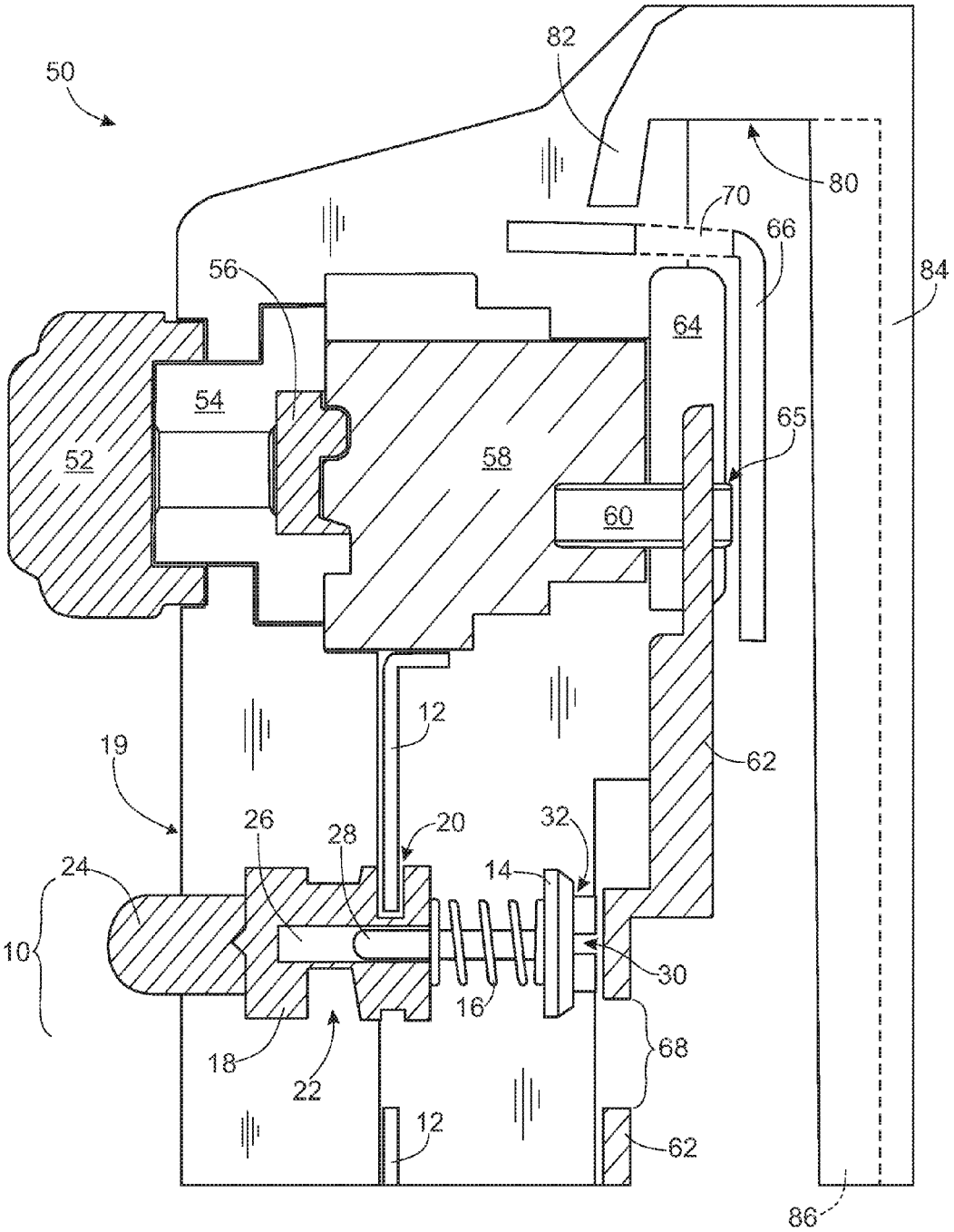
FIG. 2 is a cross section depicting a portion of a mechanical lock assembly in an unlocked position.

Each button assembly 10 can be positioned in either a "true" position in which the button tip 24 must be pressed to reflect a correct combination, or a "false" position in which the button tip is not pressed to reflect the correct combination. FIG. 1 depicts a button assembly 10 positioned in a "false" position, and the button tip 24 has not been pressed. If all button assemblies 10 from an array of button assemblies are in the correct combinational position, a knob 52 can be rotated which causes an edge 21 of the checker plate 12 to slide into gate 20 as depicted in FIG. 2. As the checker plate 12 slides into each of the gates (either 20 or 22, depending on the position of the button body 18), a locking bolt 64 is retracted from a slot 80 provided by a lip 82 in a back cover or plate 84 of the lockbox 50 such that the interior of the lockbox 50 can be accessed. The locking bolt 64 can be further retracted at least partially through an opening 70 in a lock bolt cover 66.

The lock combination is changed to a user-selected combination by repositioning any selected number of button assemblies 10. To reposition a button assembly 10, the lockbox 50 is opened using a correct lock combination to access the indicator elements 14, then a screwdriver is inserted into slot 30 of indicator element 14 and pressed toward the button tip 24 which unkeys a shoulder 32 of the indicator element 14 from keying protrusions on a back plate. This allows the indicator element 14, and thus the button assembly 10, to be rotated about 180° to the opposite orientation, and repositions the button assembly 10 to the "true" position. In the FIG. 1 depiction, the gate 22 of a button assembly 10 in the "true" position would be facing up. As will be understood from this description, the button tip 24 of a button assembly in the "true" position must be pressed to reflect the correct combination so that edge 21 of checker plate 12 can slide into gate 22 and the lock can be unlocked, as long as every other button tip 24 from the button array reflects the correct combination. If even one button tip is in a position which does not reflect the correct lock combination, the knob 52 cannot be rotated to the open position.

In FIG. 1, the lockbox 50 is in a closed and locked position. FIG. 1 depicts various elements including the knob 52, a clutch input 54 attached to knob 52, an intermediate shaft 56 in contact with clutch input 54, a clutch output 58 in contact with intermediate shaft 56, a roll pin 60 which extends from clutch output 58, a code blocker 62, a locking bolt 64, and a locking bolt cover 66. The clutch input 54, intermediate shaft 56, clutch output 58, and roll pin 60, together form a clutch. The roll pin 60 extends through an opening 65 in the locking bolt 64, as well as an opening 67 (FIG. 3) in the code blocker 62. A locking mechanism in accordance with the present teachings can have other structures which are not depicted for simplicity of explanation, while other structures may be removed or modified.

When the locking bolt 64 is in the closed position as depicted in FIG. 1, the openings 68 in the code blocker 62 expose the slots 30 on the indicator elements 14. In an embodiment, rotating knob 52 to the unlocked position, for example by rotating the knob 52 in a clockwise direction, rotates the clutch by rotating the clutch input 54, which rotates the intermediate shaft 56, which rotates the clutch output 58, which moves roll pin 60 from the FIG. 1 position to the FIG. 2 position. This rotation of the clutch results in the retraction of locking bolt 64, which is coupled to the clutch, from the slot 80 in the back plate 84, and allows the back plate 84 to swing around a pin (not depicted for simplicity) away from the lock to provide access to an item such as a key (not depicted) within a recess 86 in the back plate 84 can be accessed. The rotation of the knob 52 and thus the clutch from the locked position to the unlocked position also moves the code blocker 62 from the FIG. 1 position to the FIG. 2 position. In the FIG. 2 position, the indicator elements 14 are not exposed by the openings 68 in the code blocker 62. The rotation of the knob 52 and thus the clutch from the locked position (FIG. 1) to the unlocked position (FIG. 2) further moves the edge 21 of the checker plate 12 into one of gates 20, 22 through physical contact with the clutch output 58, if all of the button assemblies 10 reflect the correct lock combination.

If a user attempts to change the lock combination while the lock is in the unlocked position of FIG. 2, damage to the button assembly 10 can occur. An attempt by a user to rotate the indicator elements 14 to change the lock in the unlocked position of FIG. 2 results in sheer forces to the button assembly 10 through contact with the checker plate 12, and can damage a button assembly 10. The code blocker 62 blocks access to the indicator elements 14 when the lock is in the unlocked position of FIG. 2. To access the indicator elements 14 to change the combination, the lock must be placed in the locked position of FIG. 1. That is, the user must rotate the knob 52, for example in a counterclockwise direction, to place the lock in the closed position of FIG. 1. To change the code, the lock assembly is placed in the locked position of FIG. 1, except that the locking bolt 64 does not extend into the slot 80 in the back plate 84 so that the lockbox 50 remains open with the locking bolt in the locked position.

Thus the code blocker 62 prevents user access to the indicator elements 14 when the lock is in the unlocked position of FIG. 2. When the locking bolt 64 is in the locked position and the lockbox 50 is open, openings 68 allow access to indicator elements 14 such that the lock combination can be changed. In use, rotating the knob 52 from the closed position to the open position rotates the clutch to move the roll pin 60 from the FIG. 1 position to the FIG. 2 position. The roll pin 60, which extends through the hole 65 in the locking bolt 64, slides the locking bolt 64 from the slot 80 in the back plate 84 to unlock the lock, which allows the lockbox 50 to be opened. The roll pin 60 also extends through a hole 67 in the code blocker 62, and slides the code blocker 62 to cover and prevent access to indicator elements 14.

Once the lock is in the unlocked position of FIG. 2 and the lockbox 50 is opened, the user can rotate the knob 52 to the locked position of FIG. 1 with the lockbox open. As the lock is placed into the locked position of FIG. 1, the roll pin 60 slides the code blocker 62 to expose indicator elements 14 through openings 68 such that the user can change the lock combination. The roll pin 60 also slides the locking bolt 64 to the locked position of FIG. 1 (but the locking bolt 64 does not extend into the slot 80 in the back plate 84, as the lockbox 50 remains open such that the indicator elements 14 remain exposed to change the lock combination).

Figure 3:
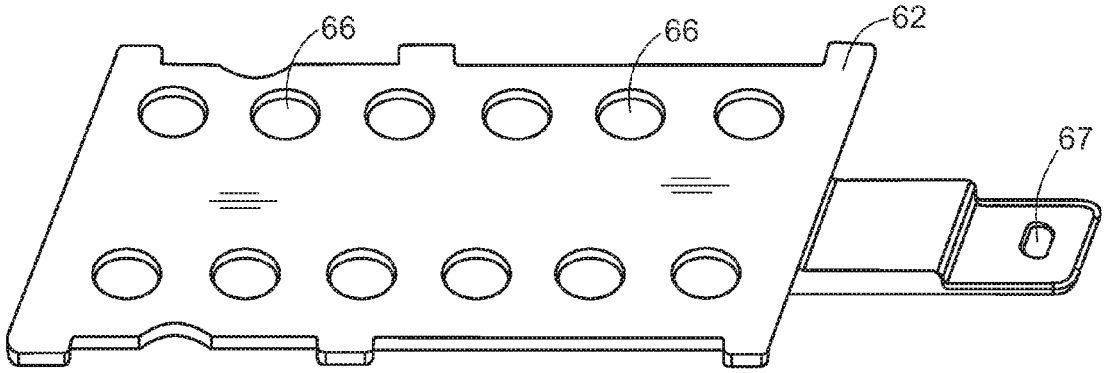
FIG. 3 is a perspective depiction of a code blocker.

FIG. 3 depicts a perspective view of the code blocker 62. Because the code blocker 62 undergoes little stress and serves to prevent user access to button assemblies 10 while the lock is in the unlocked position, the code blocker 62 can be manufactured from a low cost material such as plastic, polymer, or low grade metal. While locking bolt 64 is generally manufactured from a high strength material such as steel for security purposes, it is contemplated that code blocker 62 and locking bolt 64 can be manufactured as a single structure having a single hole through which the roll pin 60 extends.

While the present teachings have been illustrated with respect to one or more implementations, alterations and/or modifications can be made to the illustrated examples without departing from the spirit and scope of the appended claims. For example, it will be appreciated that while the process is described as a series of acts or events, the present teachings are not limited by the ordering of such acts or events. Some acts may occur in different orders and/or concurrently with other acts or events apart from those described herein. Also, not all process stages may be required to implement a methodology in accordance with one or more aspects or embodiments of the present teachings. It will be appreciated that structural components and/or processing stages can be added or existing structural components and/or processing stages can be removed or modified. Further, one or more of the acts depicted herein may be carried out in one or more separate acts and/or phases. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items can be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated embodiment. Finally, "exemplary" indicates the description is used as an example, rather than implying that it is an ideal. Other embodiments of the present teachings will be apparent to those skilled in the art from consideration of the specification and practice of the disclosure herein. It is intended that the specification and examples be considered as exemplary only, with a true scope and spirit of the present teachings being indicated by the following claims.

Terms of relative position as used in this application are defined based on a plane parallel to the conventional plane or working surface of a workpiece, regardless of the orientation of the workpiece. The term "horizontal" or "lateral" as used in this application is defined as a plane parallel to the conventional plane or working surface of a workpiece, regardless of the orientation of the workpiece. The term "vertical" refers to a direction perpendicular to the horizontal. Terms such as "on," "side" (as in "sidewall"), "higher," "lower," "over," "top," and "under" are defined with respect to the conventional plane or working surface being on the top surface of the workpiece, regardless of the orientation of the workpiece.

The invention claimed is:

1. A lock assembly comprising:

a plurality of button assemblies comprising a plurality of indicator elements, wherein a position of the plurality of indicator elements sets a lock combination; and a code blocker having a plurality of openings therein, wherein the code blocker covers every indicator element when the lock assembly is in a first position and exposes the plurality of indicator elements through the plurality of openings when the lock assembly is in a second position;

wherein the first position is an unlocked position the second position is in a locked position.

2. The lock assembly of claim 1 further comprising a clutch, wherein the clutch is configured to move the lock assembly from the first position to the second position and from the second position to the first position.

3. The lock assembly of claim 2, further comprising:

the clutch further comprises a roll pin;

the roll pin extends through an opening in the code blocker; and the roll pin is configured to move the code blocker from the locked position to the unlocked position and from the unlocked position to the locked position during rotation of the clutch.

4. The lock assembly of claim 3, wherein the clutch further comprises:

a clutch input attached to a knob;

an intermediate shaft in contact with the clutch input; and a clutch output in contact with the intermediate shaft, wherein the roll pin extends from the clutch output.

5. The lock assembly of claim 3, further comprising:

a locking bolt having an opening therein, wherein the roll pin extends through the opening in the locking bolt and the clutch is configured to move the locking bolt from a locked position to an unlocked position and from an unlocked position to a locked position during rotation of the clutch.

6. The lock assembly of claim 5, wherein the code blocker is configured to block user access to the plurality of indicator elements when the locking bolt is in the unlocked position and to allow user access to the plurality of indicator elements when the locking bolt is in the locked position.

7. A lock assembly comprising:

a plurality of button assemblies comprising a plurality of indicator elements, wherein a position of the plurality of indicator elements sets a lock combination; and a code blocker having a plurality of openings therein, wherein the code blocker covers the plurality of indicator elements when the lock assembly is in a first position and exposes the plurality of indicator elements through the plurality of openings when the lock assembly is in a second position;

the plurality of button assemblies comprises a plurality of mechanical button assemblies, wherein each mechanical button assembly comprises at least two gates, and a position of the plurality of indicator elements is configured to set the lock combination through rotation of one or more of the indicator elements.

8. The lock assembly of claim 3, further comprising:

a clutch output coupled with a knob, wherein the roll pin extends from the clutch output; and a checker plate configured to physically contact the clutch output and to slide into one of the gates of each button assembly during rotation of the clutch when the plurality of button assemblies reflects a conect lock combination, each gate comprising a cutout formed in a portion of a respective button assembly.

9. A lock assembly having a user-selectable lock combination, wherein the lock combination is selectable using a method comprising:

entering a correct lock combination;

moving a locking bolt from a locked position to an unlocked position and moving a code blocker from a first position which exposes a plurality of button assemblies through a plurality of openings in the code blocker to a second position which covers the plurality of button assemblies;

moving the locking bolt from the unlocked position to the locked position and moving the code blocker from the second position which covers the plurality of button assemblies to the first position which exposes the plurality of button assemblies; and with the locking bolt in the locked position, selecting a lock combination using the plurality of exposed button assemblies by rotating at least one exposed button assembly about a longitudinal axis of the exposed button assembly to align a gate in the exposed button assembly with a checker plate.

10. The lock assembly of claim 9, wherein the lock combination is selectable using a method which further comprises:

providing a first rotation of a clutch to move the locking bolt from the locked position to the unlocked position and to move the code blocker from the first position which exposes the plurality of button assemblies through the plurality of openings in the code blocker to the second position which covers the plurality of button assemblies; and providing a second rotation of the clutch after the first rotation to move the locking bolt from the unlocked position to the locked position and to move the code blocker from the second position which covers the plurality of button assemblies to the first position which exposes the plurality of button assemblies.

11. The lock assembly of claim 10, wherein the lock combination is selectable using a method which further comprises:

providing the first rotation and the second rotation moves a roll pin which extends through an opening in the code blocker to move the code blocker between the first position and the second position.

* * * * *